US009476592B2

(12) United States Patent
Berry

(10) Patent No.: US 9,476,592 B2
(45) Date of Patent: Oct. 25, 2016

(54) SYSTEM FOR INJECTING FUEL IN A GAS TURBINE COMBUSTOR

(71) Applicant: General Electric Company, Schenectady, NY (US)

(72) Inventor: Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 192 days.

(21) Appl. No.: 13/956,921

(22) Filed: Sep. 19, 2013

(65) Prior Publication Data

US 2015/0076251 A1 Mar. 19, 2015

(51) Int. Cl.

| | |
|---|---|
| ***F23R 3/28*** | (2006.01) |
| ***F23R 3/36*** | (2006.01) |
| ***F02C 7/22*** | (2006.01) |
| ***F02C 7/12*** | (2006.01) |
| ***F23R 3/10*** | (2006.01) |

(52) U.S. Cl.

CPC *F23R 3/286* (2013.01); *F23R 3/10* (2013.01)

(58) Field of Classification Search

CPC ..... F02C 7/22; F02C 7/12; F23R 3/286; F23R 3/28; F23R 3/36

USPC ..... 239/423, 425.5, 418; 60/226.1, 258, 60/737, 740, 748

See application file for complete search history.

(56) References Cited

U.S. PATENT DOCUMENTS 4,214,435 A * 7/1980 Campbell ..... F02C 3/30 60/39.465
4,262,482 A * 4/1981 Roffe ..... F02C 7/224 431/247
5,365,906 A * 11/1994 Deweerdt ..... F02M 37/0023 123/467
5,680,847 A 10/1997 Begley et al.
5,813,830 A 9/1998 Smith et al.
6,397,602 B2 6/2002 Vandervort et al.
6,555,000 B2 4/2003 Knight
7,096,899 B2 8/2006 Vetter et al.
7,555,946 B2 7/2009 Sawert et al.
7,785,145 B2 8/2010 Menez
7,828,509 B2 11/2010 Morris et al.
8,161,750 B2 * 4/2012 Simmons ..... F23R 3/286 60/737
8,522,555 B2 * 9/2013 Berry ..... F23R 3/286 60/746
8,683,804 B2 * 4/2014 Boardman ..... F23C 13/06 60/39.822
8,722,282 B2 * 5/2014 Cho ..... H01M 8/04208 137/613
8,899,049 B2 * 12/2014 Krull ..... F23N 5/082 356/432
8,919,673 B2 * 12/2014 Subramanian ..... F23R 3/28 239/406
2001/0030148 A1 10/2001 Knight
2005/0178469 A1 8/2005 Vetter et al.
2007/0214882 A1 9/2007 Sawert et al.
2008/0053060 A1 3/2008 Olver
2008/0078183 A1 * 4/2008 Ziminsky ..... F23R 3/36 60/776
2008/0171258 A1 * 7/2008 Takahashi ..... H01M 8/04201 429/447
2008/0199302 A1 8/2008 Morris et al.
2009/0044537 A1 * 2/2009 Boardman ..... F23R 3/286 60/737
2010/0278642 A1 11/2010 Olver
2010/0307151 A1 12/2010 French (Continued)

*Primary Examiner* — Arthur O Hall
*Assistant Examiner* — Joseph A Greenlund
(74) *Attorney, Agent, or Firm* — Barclay Damon, LLP

(57) ABSTRACT

A combustion system uses a fuel nozzle with an inner wall having a fuel inlet in fluid communication with a fuel outlet in a fuel cartridge. The inner wall defines a mounting location for inserting the fuel cartridge. A pair of annular lip seals around the cartridge outer wall on both sides of the fuel outlet seals the fuel passage between the fuel inlet and the fuel outlet.

18 Claims, 5 Drawing Sheets

(56) References Cited

U.S. PATENT DOCUMENTS

2011/0016866 A1* 1/2011 Boardman ..... F23R 3/28 60/730
2011/0314827 A1* 12/2011 Khosla ..... F23R 3/14 60/742
2013/0025285 A1* 1/2013 Stewart ..... F23R 3/10 60/740
2013/0167539 A1* 7/2013 Berry ..... F23R 3/286 60/737
2013/0299602 A1* 11/2013 Hughes ..... F23N 3/082 239/8
2013/0305739 A1* 11/2013 Berry ..... F23R 3/283 60/785
2013/0318977 A1* 12/2013 Berry ..... F23R 3/283 60/739
2014/0260267 A1* 9/2014 Melton ..... F23R 3/10 60/737
2014/0338338 A1* 11/2014 Chila ..... F23R 3/10 60/737
2015/0000286 A1* 1/2015 LeBegue ..... F23R 3/28 60/742

* cited by examiner

SYSTEM FOR INJECTING FUEL IN A GAS TURBINE COMBUSTOR

STATEMENT OF FEDERALLY SPONSORED RESEARCH OR DEVELOPMENT

This invention was made with Government support under Contract No. DE-FC26-05NT42643-DOE awarded by the Department of Energy.

BACKGROUND OF THE INVENTION

The subject matter disclosed herein relates to fuel delivery systems and more specifically, to fueling systems for gas turbine combustors.

In general, gas turbines combust a mixture of compressed air and fuel within a combustor to produce hot combustion gases. The hot combustion gases rotate blades of the turbine to rotate a shaft that drives a load, such as an electrical generator. Mixing tubes within the combustor inject fuel and air into the combustor. In some designs, the mixing tubes pre-mix the fuel and air before the fuel and air enters the combustion zone. For example, the mixing tubes may be employed to mix a gaseous fuel with air. However, the fuel nozzles may not be designed to direct liquid fuel through the mixing tubes. A separate liquid fuel supply is permanently installed between the mixing tubes and sprays liquid fuel through a nozzle into the combustor, while another fuel passage feeds gaseous fuel into the mixing tubes. It is difficult to inspect internal components of the combustion system because they are typically enclosed in a sealed housing.

The discussion above is merely provided for general background information and is not intended to be used as an aid in determining the scope of the claimed subject matter.

BRIEF DESCRIPTION OF THE INVENTION

A combustion system uses a fuel nozzle with an inner wall having a fuel inlet in fluid communication with a fuel outlet in a fuel cartridge. The inner wall defines a mounting location for inserting the fuel cartridge. A pair of annular lip seals around the cartridge outer wall on both sides of the fuel outlet seals the fuel passage between the fuel inlet and the fuel outlet. Advantages that may be realized in the practice of some disclosed embodiments of the multi-fuel cartridge system include easier inspection and repair due to the removable cartridge, and less fuel tubes in the air feed plenum to reduce air flow disruptions.

In one embodiment, a fuel nozzle assembly is disclosed which includes a fuel plenum, a fuel nozzle outer wall, and a fuel nozzle inner wall. The fuel nozzle inner wall defines a fuel cartridge location and a fuel plenum inlet which is in fluid communication with the fuel plenum. The fuel cartridge includes a fuel cartridge outer wall having a fuel cartridge outlet in fluid communication with the fuel plenum inlet when the cartridge is inserted into the cartridge location. Annular lip seals are disposed around the cartridge outer wall wherein a first one of the lip seals is on one side of the fuel cartridge outlet and a second one of the lip seals is on a second side of the fuel cartridge outlet. The lip seals seal the cartridge outer wall against the fuel nozzle inner wall in a substantially gas tight fashion.

In another embodiment, a fueling system is disclosed which includes a fuel nozzle and a removable fuel cartridge. The fuel nozzle includes a fuel plenum, a plurality of parallel mixing tubes each for delivering an air/fuel mixture through an end of the mixing tube, and a fuel cartridge chamber for securing the fuel cartridge. Each of the mixing tubes have a proximal end for receiving air, a fuel aperture through a sidewall for receiving fuel, and a distal end for delivering the air/fuel mixture. The fuel cartridge chamber is disposed substantially in parallel with the mixing tubes and includes the removable fuel cartridge that contains the fuel.

In another embodiment, a fuel nozzle system is disclosed that includes a fuel nozzle with an enclosed fuel plenum. Mixing tubes extend through the fuel nozzle, each including a first end in fluid communication with an air supply and a second end for delivering an air/fuel mixture. Apertures through the mixing tubes are in fluid communication with the fuel plenum. A mounting tube extends through the fuel nozzle for securing a removable fuel cartridge and is in fluid communication with the fuel plenum.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

The present disclosure is directed to fuel nozzles that include multi-fuel cartridges. Each fuel nozzle may have a segmented shape, such as a wedge shaped cross section, that allows the fuel nozzle to fit together with adjacent fuel nozzles to form an annular ring of fuel nozzles within a combustor of a gas turbine. A series of mixing tubes are disposed within each fuel nozzle to produce a fuel-air mixture that is directed to the combustion zone. In particular, the mixing tubes direct air from an air plenum mixed with fuel from a fuel plenum through the mixing tubes to the nozzle face. The fuel plenum surrounds the mixing tubes and gaseous fuel from the fuel plenum is directed into the mixing tubes through apertures in the side of the tubes to produce the fuel-air mixture. The fuel nozzles also may include a multi-fuel cartridge that delivers the liquid fuel, such as fuel oil or other distillates, and the gaseous fuel, such as natural gas. Accordingly, the fuel nozzles described herein may provide the flexibility to operate on liquid fuel, gaseous fuel, or a combination thereof. The multi-fuel cartridge may be located within the fuel nozzle between the mixing tubes. Accordingly, the liquid fuel may be directed through the multi-fuel cartridge to the combustion zone without flowing through the mixing tubes, and the gaseous fuel may be directed through the mixing tubes to the combustion zone.

The multi-fuel cartridge extends from the combustor front end cover through the fuel/air plenums to the nozzle face. The multi-fuel cartridge may be mounted within a cartridge holder tube that secures the multi-fuel cartridge between the mixing tubes. The multi-fuel cartridge includes an inner compartment, or passage, for storing liquid fuel and a cartridge nozzle connected to the inner compartment. The multi-fuel cartridge may also include one or more outer compartments, or passages, for storing and directing gaseous fuel to the mixing tubes. The multi-fuel cartridge may also include air and/or water passages to direct air, water, or a combination thereof, through the multi-fuel cartridge. The cartridge nozzle may be located at the end of the multi-fuel cartridge to expel, or spray, the liquid fuel into the combustion zone. According to certain embodiments, the cartridge nozzle expels, or sprays, the liquid fuel radially outward toward into the combustion zone. The mixing tubes may be disposed radially around the multi-fuel cartridge in a pattern designed to promote efficient mixing of the gaseous fuel and the liquid fuel.

Figure 1:
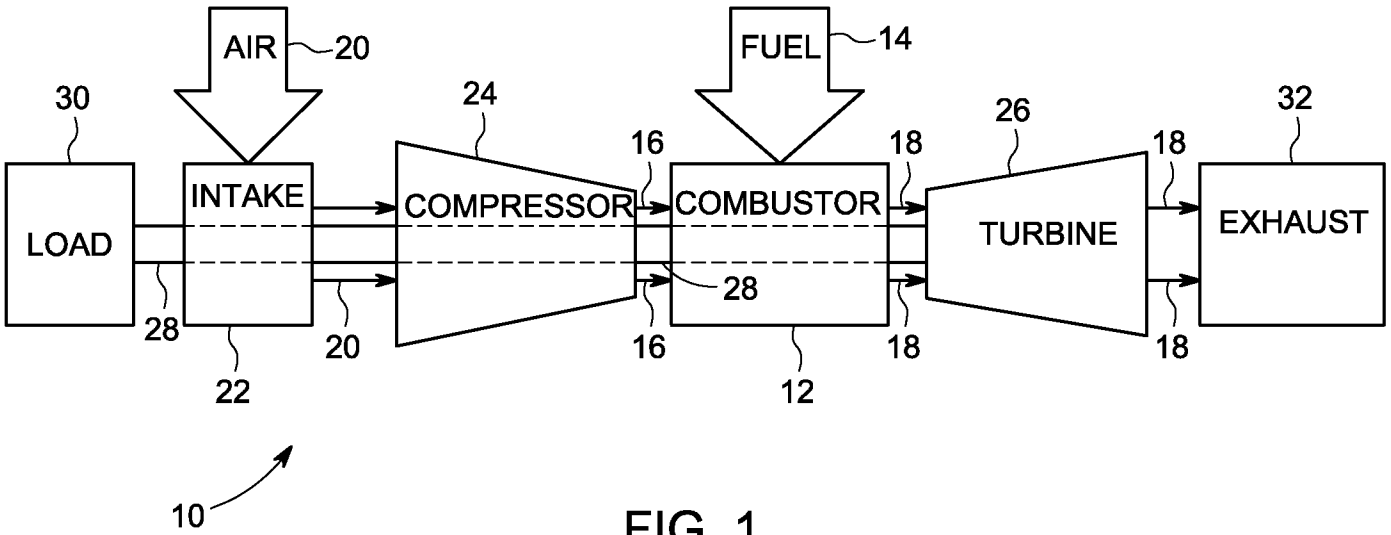
FIG. 1 is a schematic flow diagram of an embodiment of a gas turbine system that may employ fuel nozzles with multi-fuel cartridges.

FIG. 1 is a block diagram of an embodiment of a gas turbine system 10 that employs sector fuel nozzles that include multi-fuel cartridges. The gas turbine system 10 may be part of a simple cycle system or a combined cycle system. The gas turbine system 10 includes a combustor 12 that combusts fuel 14 to drive the gas turbine system 10. According to certain embodiments, the fuel 14 may be a liquid or gaseous fuel, or a combination thereof, such as natural gas, light or heavy distillate oil, naphtha, crude oil, residual oil, or syngas.

Within the combustor 12, the fuel 14 may mix with pressurized air 16, shown by arrows, and ignition may occur, producing hot combustion gases 18 that power the gas turbine system 10. As discussed further below with respect to FIG. 2, the combustor 12 includes sector fuel nozzles that pre-mix the gaseous fuel 14 and the pressurized air 16 and direct the fuel-air mixture into a combustion chamber in a suitable ratio for optimal combustion, emissions, fuel consumption, and power output. Further, the fuel nozzles also may include multi-fuel cartridges that direct liquid fuel into the combustion chamber.

The pressurized air 16 includes intake air 20 that enters the gas turbine system 10 through an air intake section 22. The intake air 20 is compressed by a compressor 24 to produce the pressurized air 16 that enters the combustor 12. The sector fuel nozzles may direct the fuel 14 and the pressurized air 16 into the combustion zone of the combustor 12 together with the liquid fuel expelled from the multi-fuel cartridges. Within the combustion zone, the pressurized air 16 combusts with the liquid and gaseous fuel 14 to produce the hot combustion gases 18. From the combustor 12, the hot combustion gases 18 may flow through a turbine 26 that drives the compressor 24 via a shaft 28. For example, the combustion gases 18 may apply motive forces to turbine rotor blades within the turbine 26 to rotate the shaft 28. Shaft 28 also may be connected to a load 30, such as a generator, a propeller, a transmission, or a drive system, among others. After flowing through the turbine 26, the hot combustion gases 18 may exit the gas turbine system 10 through an exhaust section 32.

Figure 2:
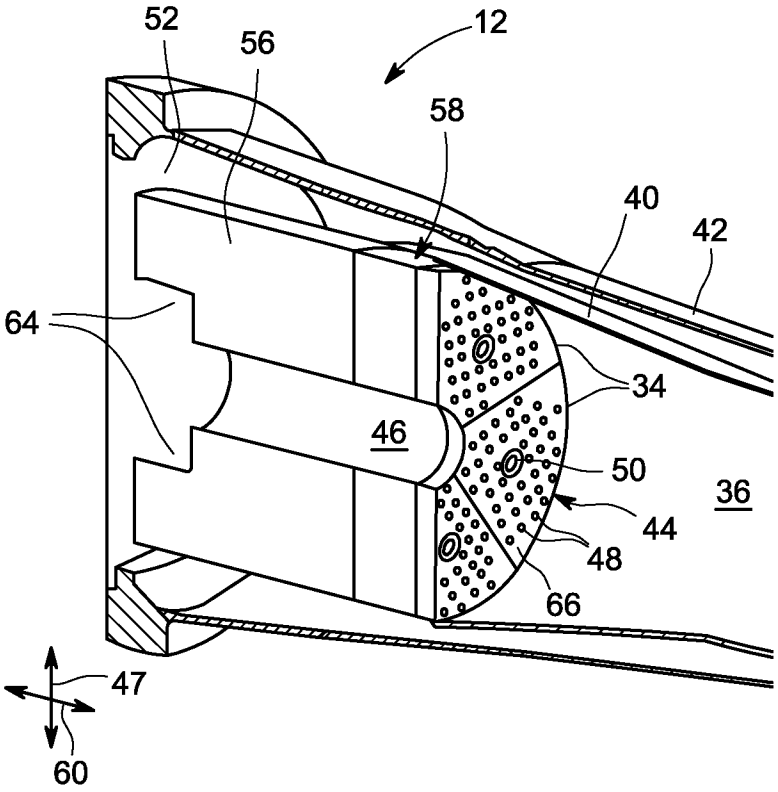
FIG. 2 is a cross-sectional view of the combustor of FIG. 1.

FIG. 2 is a cross-sectional view of an embodiment of the combustor 12. The combustor 12 includes fuel nozzles 34 that inject the gaseous fuel-air mixture into a combustion chamber 36. The combustion chamber 36 is generally defined by a casing 42, and a liner 40.

The fuel nozzles 34 are arranged adjacent to one another to form a generally circular fuel nozzle assembly 44. According to certain embodiments, each fuel nozzle 34 has a wedge-shaped cross section designed to abut a pair of adjacent fuel nozzles 34. Further, in certain embodiments, each fuel nozzle 34 may be arranged around a central opening 46. Each fuel nozzle 34 may extend outward from the central opening 46 in the radial direction 47. Each fuel nozzle 34 includes mixing tubes 48 that mix the gaseous fuel 14 and air to form a fuel-air mixture that is injected into the combustion chamber 36. One or more of the fuel nozzles 34 also may include a multi-fuel cartridge 50 that injects liquid fuel into the combustion chamber 36 and directs gaseous fuel to the mixing tubes 48. These fuels may be contained under pressure within the multi-fuel cartridge 50. As discussed further below with respect to FIG. 3, the mixing tubes 48 may be disposed around the multi-fuel cartridge 50.

The fuel nozzles 34 each include a base 52 that secures the fuel nozzle 34 of the combustor 12. A shell 56 extends between the base 52 and mixing tube fuel/air plenums 58 in the axial direction 60. The shell 56 generally encloses an air feed plenum 62 (FIG. 3) that directs air from the compressor through the interior of the fuel nozzles 34 to the mixing tubes 48, which extend through the mixing tube fuel/air plenums 58 to a face plate 66. The shell 56 includes openings 64 that allow air flow 43 (FIG. 4) from the compressor to enter the air feed plenum 62. Within the mixing tube fuel/air plenums 58, the gaseous fuel may enter the mixing tubes 48 through holes in the sides of the mixing tubes 48 to produce the fuel-air mixture that flows through the mixing tubes 48 to enter the combustion chamber 36. The multi-fuel cartridge 50 extends through the base 52, the air feed plenum 62, and the mixing tube fuel/air plenums 58 to direct liquid fuel into the combustion chamber 36 and gaseous fuel into the mixing tubes 48. Within the combustion chamber 36, the gas and liquid fuel-air mixture is combusted to produce the hot combustion gases 18. From the combustion chamber 36, the hot combustion gases 18 flow to the turbine 26.

Figure 3:
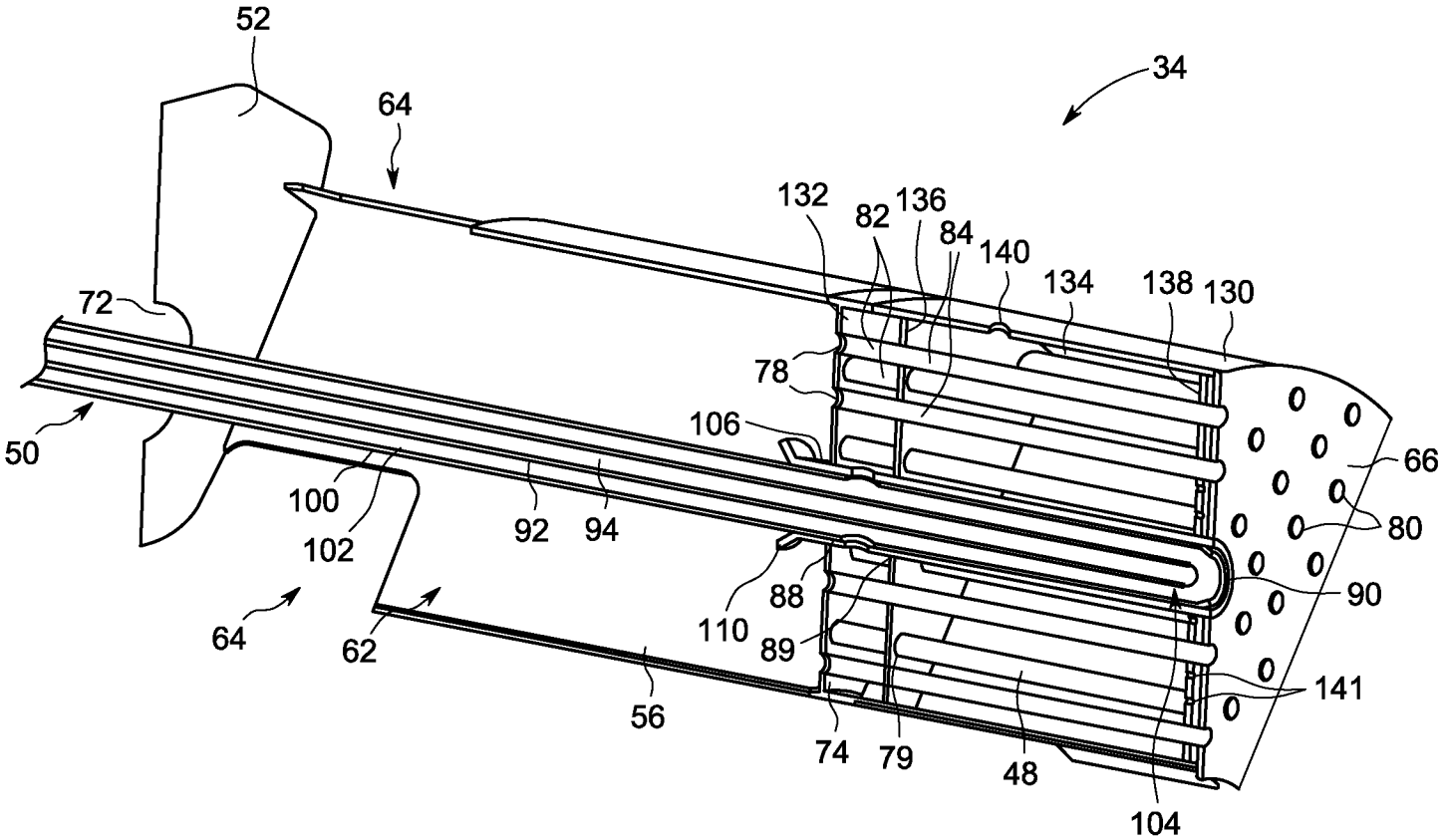
FIG. 3 is a cross-sectional view of an embodiment of a fuel nozzle of the combustor of FIG. 1.

FIG. 3 depicts one of the fuel nozzles 34 sectioned to show the interior of the fuel nozzle 34. The multi-fuel cartridge 50 extends through an aperture 72 in the base 52, through the air feed plenum 62, through the fuel plenum 132, and through the air plenum 134 to the face plate 66. The fuel plenum 132 is generally defined by a fuel plenum plate 74 and the interior plate 136. The air plenum 134 is generally defined by the interior plate 136 and the face plate 66. The interior plate 136 is disposed generally parallel to the fuel plenum plate 74 and the face plate 66 and divides the interior side of the outer housing, or outer wall, 130 into the fuel plenum 132 and the air plenum 134. An alternative cooling plate 138 may be disposed adjacent the face plate 66 on its interior surface. The outer housing, or outer wall, 130 is coupled to the fuel plenum plate 74, the interior plate 136, and the cooling and face plates 138, 66, respectively to enclose the fuel plenum 132 and the air plenum 134. The outer housing 130 may include a series of air purge holes 140 that direct air into the air plenum 134. The air from the air plenum 134 then flows through openings 141 in the cooling plate 138 to provide cooling to the face plate 66. The air from the air plenum 134 may also flow out of the fuel nozzle 34 through openings 142 (FIG. 4) between the mixing tubes and the face plate 66, as shown by arrows 143 (FIG. 4), thereby providing an aft face cooling air path by purging hot air and any fuel leaking into the air plenum 134.

The mixing tubes 48 extend through the fuel plenum 132 and the air plenum 134 and are mounted in apertures 78 in the fuel plenum plate 74, apertures 79 in the inner plate 136, and apertures 80 in the face plate 66. The mixing tubes 48 include apertures 82 in the tube walls 84 that allow gaseous fuel from the fuel plenum 132 to enter the mixing tubes 48. Air flow 43 enters the fuel nozzle 34 through openings 64 in the shell 56, and then flows through the air feed plenum 62 to enter the ends of the mixing tubes 48 through the apertures 78 in the fuel plenum plate 74. Within the mixing tubes 48, the air mixes with fuel that enters the mixing tubes 48 through the apertures 82 to produce the fuel-air mixture that is directed into the combustion chamber 36. In particular, the fuel-air mixture exits the mixing tubes 48 through the apertures 80 in the face plate 66. In certain embodiments the air in air plenum 134 may be employed to cool the cooling plate 138, and thereby the face plate 66 which is adjacent to the cooling plate 138.

The mixing tubes 48 are disposed radially around the multi-fuel cartridge 50, which extends through an aperture 88 in the fuel plenum plate 74, an aperture 89 in the inner plate 136, and an aperture 90 in the face plate 66. As shown in FIG. 3, the apertures 88, 89, and 90 are centered within the fuel plenum plate 74, the inner plate 136, and the face plate 66, respectively. Accordingly, the multi-fuel cartridge 50 extends axially through the approximate center of the fuel nozzle 34. However, in other embodiments, the locations of the apertures 88, 89, and 90 may vary to dispose the multi-fuel cartridge 50 in other positions within the fuel nozzle 34.

Figure 4:
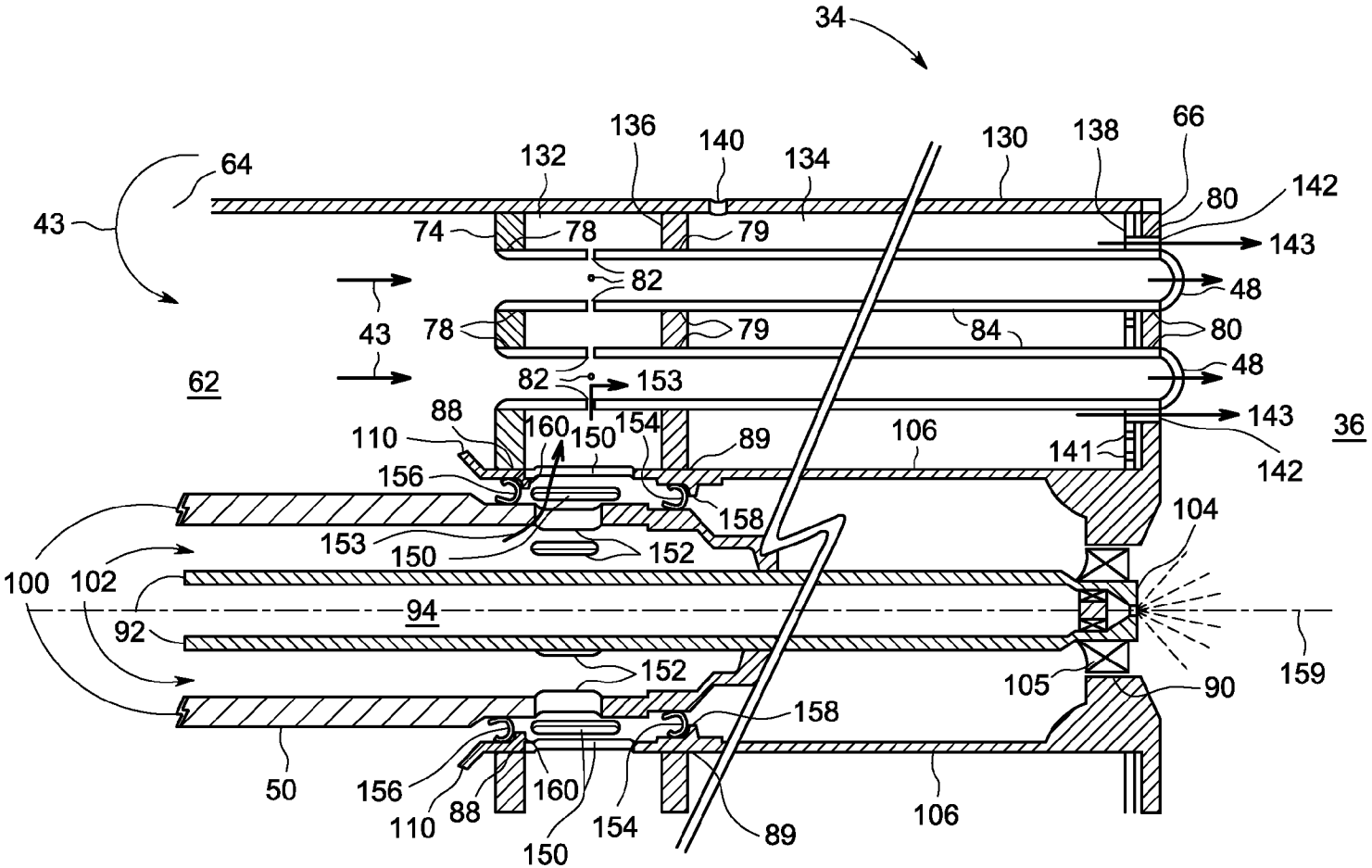
FIG. 4 is a cross section view of an embodiment of the fuel nozzle that includes a multi-fuel cartridge.

The multi-fuel cartridge 50 includes an inner tube 92 that defines an inner liquid fuel passage, or compartment, 94, and an outer tube, or wall, 100 that defines a gaseous fuel passage, or compartment, 102. According to certain embodiments, liquid fuel, water, and air, such as high-pressure atomizing air, may be supplied to the inner fuel compartment 94 of the multi-fuel cartridge 50 through inlets in the multi-fuel cartridge 50 that are external to the fuel nozzle 34. The multi-fuel cartridge 50 also includes a nozzle portion 104 that expels, or sprays, the liquid fuel which may include water and/or air, from the inner passage 94 through the face plate 66 into the combustion chamber 36 (FIG. 4). As shown, the multi-fuel cartridge 50 includes at least two concentric tubes, or interior walls, 92 and 100 that define two separate compartments 94 and 102, respectively, whose contents may be pressurized. In other embodiments, any number of one or more tubes, or walls, may be included within the multi-fuel cartridge 50. For example, in certain embodiments, the multi-fuel cartridge 50 may include an additional tube that defines a passage to separately supply water or air, or a combination thereof, to the combustion zone.

The multi-fuel cartridge 50 is disposed within a mounting tube 106, which also serves as the inner wall of the fuel nozzle 34, that extends through the fuel plenum 132 and the air plenum 134 and is mounted within the aperture 88 in the fuel plenum plate 74, aperture 89 in the inner plate 136, and the aperture 90 in the face plate 66. The mounting tube 106 may fit snugly within the apertures 88, 89, and 90 to inhibit the escape of gaseous fuel through the apertures 88, 89, and 90. The mounting tube 106 may include a lip 110 designed to assist in the insertion of the multi-fuel cartridge into the mounting tube 106. In some embodiments, the mounting tube 106 may fit snugly around the outer tube 100 of the multi-fuel cartridge 50. In some embodiments, the inside diameter of the mounting tube 106 may be slightly greater than the outside diameter of the multi-fuel cartridge 50 to allow interoperation with lip seals mounted to the outer wall 100 of the multi-fuel cartridge 50, as will now be described.

FIG. 4 is a cross-sectional view of an embodiment of a fuel nozzle 34 containing a multi-fuel cartridge 50 fully inserted into the mounting tube 106. The multi-fuel cartridge 50 comprises a pair of annular lip seals including a first lip seal 154 and a second lip seal 156. The lips seals, 154, 156 are made from a thin sheet of metal, such as aluminum or an Inconel alloy, for example, curled into a substantially C-shaped cross-section and circumferentially attached to the outer wall 100 of the multi-fuel cartridge. The thin cross-section provides a flexible response from the lip seals 154, 156 against the inner wall of the mounting tube 106 when the multi-fuel cartridge 50 is inserted therein. The first lip seal 154 is seated against a first seal retention projection 158 which is formed on the inner wall of the mounting tube 106. The second lip seal 156 is seated against a second seal retention projection 160 which is also formed on the inner wall of the mounting tube 106. The seal retention projections 158, 160 include a curvature preferably contoured similar to the curvature of the corresponding lip seal 154, 156 to help provide a gas tight seal between the multi-fuel cartridge and the inner wall of the mounting tube 106 when the lip seals 154, 156 physically contact the seal retention projections 158, 160. The first lip seal 154 may include a smaller diameter than second lip seal 156 to allow easier insertion of the multi-fuel cartridge 50 into the mounting tube 106, in particular, to allow the first lip seal to more easily bypass the seal retention projection 160 without substantial interference therewith, thereby avoiding excessive wear that might otherwise result. The multi-fuel cartridge 50 may be inserted into mounting tub 106 via aperture 72 of the base 52, then through the lip 110 of the mounting tube 106 until the cartridge nozzle 104 is seated in face plate 66 aperture 90, and the first and second lip seals 154, 156 each abut their corresponding seal retention projections 158, 160. The multi-fuel cartridge 50 may also be removed from the mounting tube 106 in a reverse fashion. This breach loading capability of the multi-fuel cartridge allows easy inspection of the interior of the fuel nozzle 34 using, for example, a boroscope inserted through aperture 72 of the base 52 when the multi-fuel cartridge 50 is removed. The outer wall 100 and the inner wall 92 of the multi-fuel cartridge 50, and the mounting tube 106, each comprise a substantially circular cross-section disposed substantially concentrically about multi-fuel cartridge axis 159.

The cartridge nozzle 104 is in fluid communication with the inner compartment 94 to expel liquid fuel from the inner compartment 94 into the combustion chamber 36. As described above, the liquid fuel 14 may include light or heavy distillate oil, naphtha, crude oil, residual oil, or a combination thereof, and water and/or air. In one embodiment, the liquid fuel comprises an emulsion of fuel oil and water. When the multi-fuel cartridge 50 is fully inserted into the mounting tube 106, the cartridge nozzle 104 is disposed in aperture 90 of the face plate 66. The cartridge nozzle 104 may comprise an atomizing rotating air swirler 105, with an annular ridge to assist insertion and fit of the cartridge nozzle 104 into the aperture 90.

The mounting tube 106 includes several openings forming fuel plenum inlets 150 between the interior of the mounting tube 106 and the fuel plenum 132. The fuel plenum inlets are formed in the mounting tube between the fuel plenum plate 74 and the inner plate 136. The multi-fuel cartridge 50 includes several openings through its outer wall 100 forming gaseous fuel outlets 152 corresponding to, and axially aligned with, the fuel plenum inlets 150. Thus, gaseous fuel 14 in the outer passage 102 of multi-fuel cartridge 50 is in fluid communication with the fuel plenum 132 via the gaseous fuel outlets 152 and the fuel plenum inlets 150, and may be delivered therethrough along a fuel flow path as indicated by arrows 153. The gaseous fuel outlets 152 may be selectively sized to control a magnitude of gaseous fuel differential pressure across apertures 82 for controlling fuel injection therethrough to optimize fuel mixing in the mixing tubes 48. The lips seals 154, 156 are disposed in a gas tight fashion on either side of the axially aligned fuel plenum inlets 150 and the gaseous fuel outlets 152 and between the outer wall of the multi-fuel cartridge 50 and the inner wall of the mounting tube 106 to secure passage of fuel into the gaseous fuel plenum 132 and to substantially prevent unnecessary dilution or leakage of the gaseous fuel.

Figure 5:
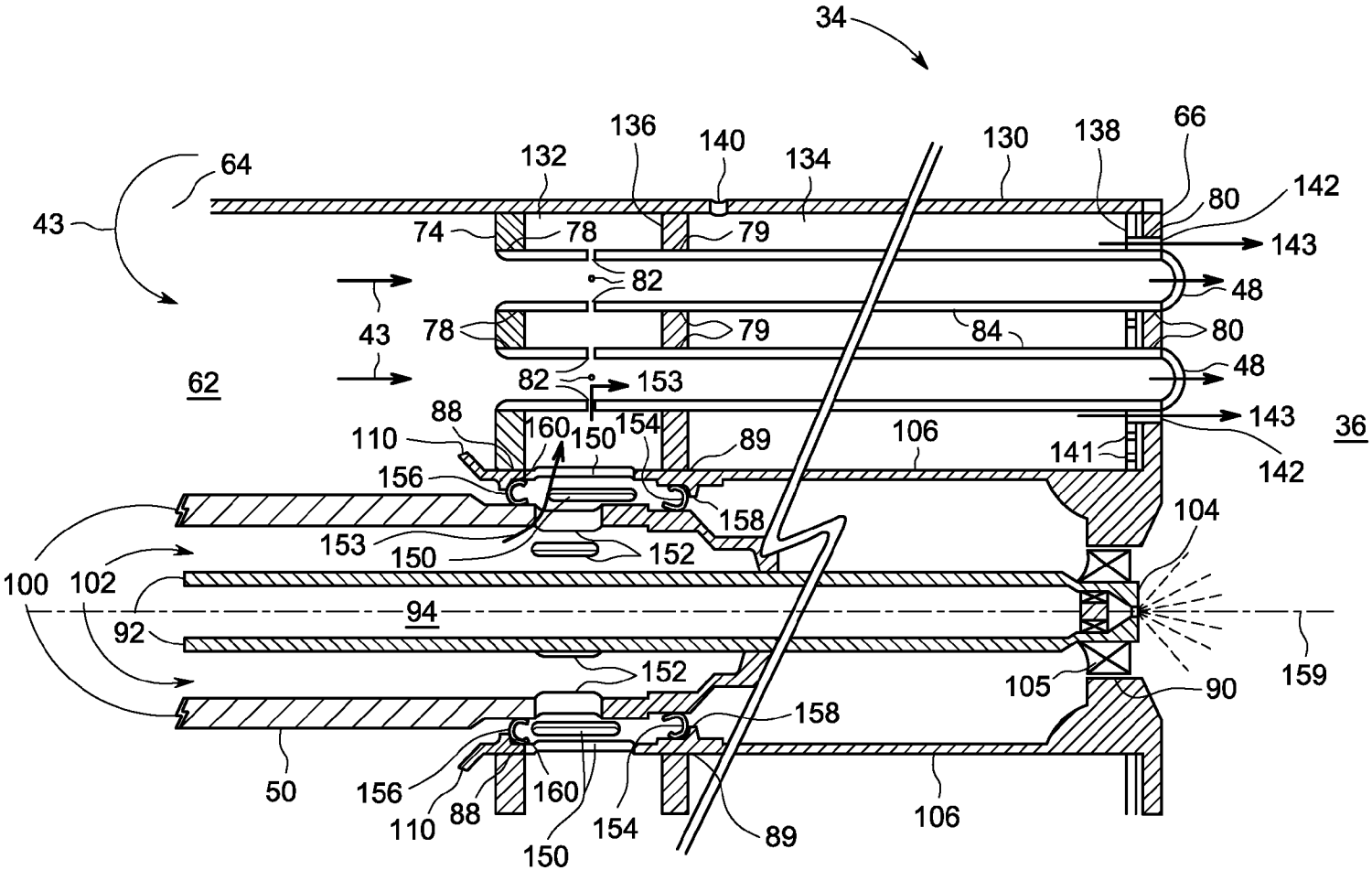
FIG. 5 is a cross section view of another embodiment of the fuel nozzle that includes a multi-fuel cartridge.

FIG. 5 is a cross-sectional view of an embodiment of the fuel nozzle 34 containing a multi-fuel cartridge 50 fully inserted into the mounting tube 106. This embodiment is identical in all respects to the embodiment as shown in FIG. 4 except that the second annular lip seal 156 now faces in an opposite direction and its corresponding retention projection 160 is positioned on the side of the second lip seal 156 away from gaseous fuel outlets 152. The seal retention projection 160 includes a curvature preferably contoured similar to the curvature of the corresponding lip seal 156, as before, to help provide a gas tight seal between the multi-fuel cartridge and the inner wall of the mounting tube 106. This embodiment may be advantageous in applications wherein high gaseous fuel pressure is required because the higher fuel pressure expands the lip seals 154, 156 so that their outer surfaces press against the retention projections 158, 160 to form a gas tight seal, and so are better positioned to channel the fuel through the gaseous fuel outlets 152.

When fully assembled, the fueling system provided by the multi-fuel cartridge 50 delivers liquid and gaseous fuel 14 simultaneously to combustion chamber 36 using one cartridge in a simplified design. The air feed plenum 62 is kept uncluttered by other tubes typically required to provide fuel passages to the fuel plenum 132, thereby avoiding wakes in the air flow and other air flow non-uniformities that might disrupt air delivery to the fuel nozzle 34. The breach loading feature of the multi-fuel cartridge system further simplifies inspection by providing access to the interior of the fuel nozzle using visual inspection tools such as boroscopes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel nozzle assembly comprising:

a fuel plenum, a fuel nozzle outer wall, and a fuel nozzle inner wall, the fuel nozzle inner wall defining a cartridge location and comprising a fuel plenum inlet in fluid communication with the fuel plenum;

a plurality of mixing tubes extending through the fuel plenum between the fuel nozzle outer wall and the fuel nozzle inner wall, the plurality of mixing tubes each for delivering an air/fuel mixture through one end of the mixing tube, wherein the mixing tubes are disposed substantially in parallel to each other;

a removable fuel cartridge located in the cartridge location defined by the fuel nozzle inner wall outside of each of the plurality of mixing tubes, the removable fuel cartridge comprising:

a fuel cartridge outer wall, the fuel cartridge outer wall comprising a fuel cartridge outlet in fluid communication with the fuel plenum inlet when the removable fuel cartridge is inserted into the cartridge location;

a first cartridge compartment disposed around an axis of the cartridge and a second cartridge compartment disposed between the fuel cartridge outer wall and the first cartridge compartment, wherein the first cartridge compartment is configured to contain a pressurized liquid fuel and the second cartridge compartment is configured to contain a pressurized gaseous fuel for delivery through the fuel cartridge outlet into the fuel plenum, wherein the removable fuel cartridge is configured so that the liquid fuel is directed through the removable fuel cartridge without flowing through the mixing tubes; and annular lip seals disposed around the fuel cartridge outer wall between the fuel cartridge outer wall and the fuel nozzle inner wall, a first one of the lip seals on one side of the removable fuel cartridge outlet and a second one of the lip seals on a second side of the removable fuel cartridge outlet for sealing the fuel cartridge outer wall against the fuel nozzle inner wall in a substantially gas tight fashion.

2. The fuel nozzle assembly of claim 1, wherein the first cartridge compartment comprises a spray opening for spraying fuel into a combustion chamber.

3. The fuel nozzle assembly of claim 2, wherein the fuel cartridge outlet extends from the second cartridge compartment through the cartridge outer wall.

4. The fuel nozzle assembly of claim 1, wherein the liquid fuel comprises an emulsified mixture of fuel oil and water, and wherein the gaseous fuel comprises natural gas.

5. The fuel nozzle assembly of claim 1, wherein the fuel nozzle outer wall is shaped to include a pair of mating surfaces such that the mating surfaces of a plurality of fuel nozzles are placed adjacent to each other to form a generally circular arrangement.

6. A fueling system comprising:

a fuel nozzle comprising:

a fuel plenum;

a plurality of mixing tubes each for delivering an air/fuel mixture through one end of the mixing tube, wherein the mixing tubes are disposed substantially in parallel to each other, the mixing tubes each comprising:

a proximal end for receiving the air which travels through the mixing tube, at least one fuel aperture through a sidewall of the mixing tube in fluid communication with the fuel plenum for receiving a fuel portion of the air/fuel mixture that mixes with the air traveling through the mixing tube, and a distal end comprising said one end of the mixing tube for delivering the air/fuel mixture therethrough, and a fuel cartridge chamber disposed substantially in parallel with and outside of each of the plurality of mixing tubes; and a removable fuel cartridge inserted into the fuel cartridge chamber, wherein the removable fuel cartridge comprises a first fuel compartment configured to contain a liquid fuel and a second fuel compartment configured to contain the fuel that mixes with the air, and wherein the removable fuel cartridge is configured so that the liquid fuel is directed through the removable fuel cartridge without flowing through the mixing tubes.

7. The fueling system of claim 6, wherein the first fuel compartment comprises an opening at its distal end for spraying the liquid fuel.

8. The fueling system of claim 7, wherein the removable fuel cartridge further comprises:

a fuel outlet extending from the second fuel compartment through an outer wall of the removable fuel cartridge, the fuel outlet in fluid communication with the fuel plenum in the fuel nozzle when the removable fuel cartridge is inserted into the fuel cartridge chamber.

9. The fueling system of claim 8, further comprising annular lip seals disposed circumferentially along an outer wall of the removable fuel cartridge substantially in parallel with each other, wherein a first one of the lip seals is disposed on one side of the fuel outlet and a second one of the lip seals is disposed on a second side of the fuel outlet for providing a substantially gas tight seal between the outer wall of the removable fuel cartridge and a wall of the fuel cartridge chamber.

10. The fueling system of claim 9, wherein the wall of the fuel cartridge chamber comprises a pair of annular seal retention projections each having a contour matching a contour of one of the lip seals for sealingly mating therewith when the removable fuel cartridge is inserted into the fuel cartridge chamber.

11. The fueling system of claim 8, wherein the fuel that mixes with the air comprises natural gas and the liquid fuel comprises an emulsion of fuel oil and water.

12. A fuel nozzle system comprising:

a fuel nozzle comprising an enclosed fuel plenum;

a plurality of mixing tubes extending through the fuel nozzle, the mixing tubes each comprising a first end in fluid communication with an air supply and a second end for delivering an air/fuel mixture, each of the mixing tubes comprising apertures therethrough in fluid communication with the fuel plenum; and a mounting tube extending through the fuel nozzle and outside of each of the plurality of mixing tubes for receiving and securing a removable fuel cartridge therein, the mounting tube including an opening therethrough for establishing fluid communication between an interior of the mounting tube and the fuel plenum, a removable fuel cartridge located in the mounting tube, wherein the removable fuel cartridge comprises a gaseous fuel compartment configured to contain gaseous fuel in fluid communication with the fuel plenum through an opening in an outer wall of the removable fuel cartridge and the opening in the mounting tube and a liquid fuel compartment configured to contain liquid fuel separate from the gaseous fuel and having a nozzle for expelling the liquid fuel, and wherein the removable fuel cartridge is configured so that the liquid fuel is directed through the removable fuel cartridge without flowing through the mixing tubes.

13. The fuel nozzle system of claim 12, wherein the removable fuel cartridge is received and secured in the mounting tube.

14. The fuel nozzle system of claim 13, further comprising:

lip seals disposed between the mounting tube and the removable fuel cartridge, a first one of the lip seals on a first side of the mounting tube opening and the opening in the fuel cartridge outer wall, and a second one of the lip seals on a second side of the mounting tube opening and the opening in the fuel cartridge outer wall.

15. The fuel nozzle system of claim 14, wherein the mounting tube comprises seal retention projections on an interior side of the mounting tube for mating against the lip seals when the removable fuel cartridge is inserted into the mounting tube.

16. The fuel nozzle assembly of claim 1, wherein the plurality of mixing tubes are disposed radially around the removable fuel cartridge.

17. The fueling system of claim 6, wherein the plurality of mixing tubes are disposed radially around the removable fuel cartridge.

18. The fuel nozzle system of claim 12, wherein the plurality of mixing tubes are disposed radially around the removable fuel cartridge.

* * * * *